United States Patent [19]

Weil

[11] Patent Number: 4,683,926

[45] Date of Patent: Aug. 4, 1987

[54] SLICER DOGS FOR THIRDS AND QUARTERS

[75] Inventor: George Weil, Missisauga, Canada

[73] Assignee: David R. Webb Co., Inc., Edinburgh, Ind.

[21] Appl. No.: 846,894

[22] Filed: Apr. 1, 1986

[51] Int. Cl.[4] ..... B27L 5/06

[52] U.S. Cl. ..... 144/178; 144/214; 269/54.1

[58] Field of Search ..... 144/177, 178, 214, 209 R; 269/54.1, 54.2, 54.3

[56] References Cited

U.S. PATENT DOCUMENTS 828,065 8/1906 Smith et al. .
1,786,460 12/1930 Stone .
2,261,497 11/1941 Hill .
2,397,110 3/1946 Hill .
3,397,723 8/1968 Hervey .
3,680,612 8/1972 Hale ..... 144/178
4,102,372 7/1978 Cremona .
4,503,896 3/1985 Brand .

FOREIGN PATENT DOCUMENTS 187296 12/1955 Austria ..... 144/178
669407 12/1938 Fed. Rep. of Germany .

*Primary Examiner*—W. D. Bray
*Attorney, Agent, or Firm*—Barnes & Thornburg

[57] ABSTRACT

Slicer dogs for use in a veneer slicer in which a flitch is held against a flitch table and the table reciprocated in a plane generally parallel to the table relative to a knife and pressure bar. The knife slices sheets of veneer from the flitch during alternate reciprocations. The dogs have plural rows of teeth to assist in holding the flitch on the slicer.

14 Claims, 3 Drawing Figures

SLICER DOGS FOR THIRDS AND QUARTERS

This invention relates to slicer dogs for use in a veneer slicer in which a flitch is held against a flitch table and the table is reciprocated in a plane generally parallel to the table relative to a knife and pressure bar. The knife slices sheets of veneer from the flitch during alternate reciprocations.

Veneer slicers of the general type to which the present invention relates are known. There are, for example, the devices illustrated in Cremona U.S. Pat. No. 4,102,372; Brand U.S. Pat. No. 4,503,896 and Weil U.S. patent application Ser. No. 499,503, filed May 31, 1983, titled Control System For Veneer Slicer, assigned to the same assignee as the present invention.

It is not uncommon for logs to be split lengthwise so that three or four flitches, each constituting a 120° or 90° sector, respectively, of a log and having the same longitudinal extent as the log, result. This is sometimes done for purposes of achieving a particular pattern in the veneer. In the past, different dogs have been used to secure these thirds and quarters to the flitch table. Switching back and forth between the cutting of thirds and the cutting of quarters has necessitated changing the dogs through which the veneer slicer's dog system grips the flitch to be sliced. It has also been found that the dogs which are presently used in the slicing of thirds and quarters sometimes permit the flitches to work loose during a slicing operation. This permits some movement of the flitches as slices of veneer are cut from them, frequently resulting in inferior, sometimes unusable, veneer slices.

It is an object of the present invention to provide a dog which is useful in the slicing of both thirds and quarters.

It is a further object to provide a dog which grips flitches more securely than prior art "single line of contact" dogs.

According to the invention, a dog for a veneer slicer comprises means for mounting the dog to the slicer to hold a flitch to the slicer. The dog includes a first tooth having a first edge extending generally longitudinally of the flitch along a first line for engagement in the flitch to assist in holding the flitch on the slicer so that veneer can be sliced from it. The dog also includes a second tooth having a second edge extending along a second line spaced from, and generally parallel to, the first edge for engagement in the flitch to assist in holding the flitch on the slicer.

According to the invention, the dog comprises a first row of teeth, the first row extending generally longitudinally of the flitch for engagement in the flitch to assist in holding the flitch on the slicer, and a second row of teeth extending generally parallel to the first row for engagement in the flitch to assist in holding the flitch on the slicer.

According to the illustrative embodiment, each tooth of the first row is substantially equidistantly spaced from adjacent teeth of the first row defining substantially uniform spaces between the teeth of the first row longitudinally of the flitch. Each tooth of the second row is substantially equidistantly spaced from adjacent teeth of the second row defining substantially uniform spaces between the teeth of the second row. The teeth of the second row lie in the spaces between the teeth of the first row when viewed from a direction perpendicular to the longitudinal extent of the flitch, particularly when viewed from a direction perpendicular to the mounting surface of the flitch table against which the flitch is to be held for slicing. Illustratively, the teeth of the second row are generally centered in the spaces between the teeth of the first row when viewed from this direction.

Additionally, according to the illustrative embodiment, a line between the tip of a tooth of the first row and the tip of a tooth of the second row projects onto a plane perpendicular to the longitudinal extent of the flitch an angle of about 30° with the flitch table.

The invention may best be understood by referring to the following description and accompanying drawings which illustrate the invention. In the drawings.

Figure 1:
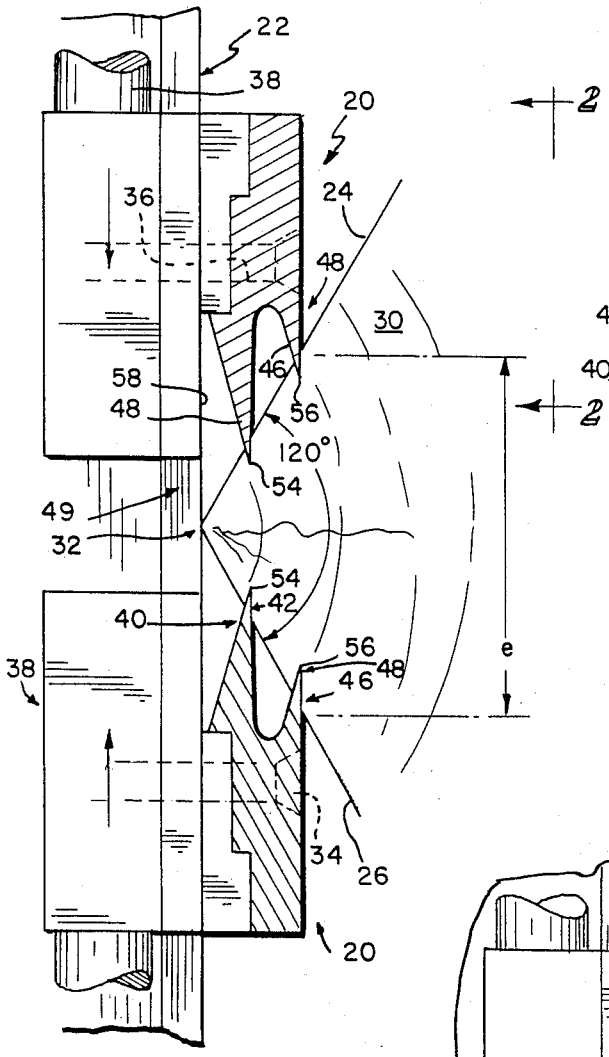
FIG. 1 illustrates a cross section of a 120° sector flitch, or third, with two dogs according to the present invention holding the flitch in position against a flitch table.
Figure 2:
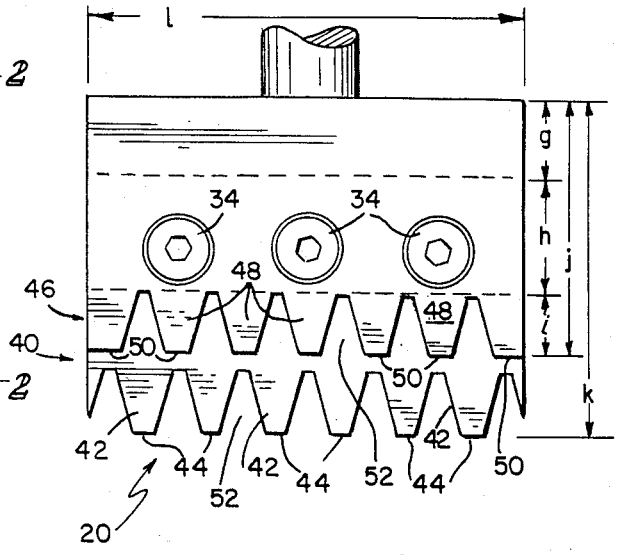
FIG. 2 illustrates a front elevational view of a dog constructed according to the present invention, taken generally along section lines 2—2 of FIG. 1.

Turning now to FIGS. 1–2, dogs 20 constructed according to the present invention are mounted on a veneer slicer 22 and engage upper and lower surfaces 24, 26, respectively, of a third 30 near its apex 32. As previously discussed, the third subtends an angle of 120°. The dogs 20 are mounted to the veneer slicer 22 by bolts 34 which extend through passageways 36 provided in each of dogs 20 and bolt the dogs 20 to an elevator mechanism 38 which may be a pneumatic or hydraulic piston-and-cylinder arrangement, as described in U.S. Pat. No. 4,503,896 or a screw-type elevator mechanism as described in U.S. Pat. No. 4,102,372. As best illustrated in FIG. 2, each dog 20 includes a first row 40 of teeth 42. When viewed through a plane perpendicular to the longitudinal extent of the flitch 30 (as in FIG. 1), the edges 44 of the teeth 42 in the first row 40 are colinear along a first line. Dog 20 also includes a second row 46 of teeth 48, the edges 50 of which are colinear along a second line, as can be seen from FIG. 1.

With the exception of the end teeth in each of the first and second rows 40, 46, respectively, each tooth 42, 48 is somewhat trapezoidal in configuration in plan view (FIG. 2), with its larger base being the locus of its attachment to the rest of the dog 20, and its smaller base terminating at edge 44, 50, respectively. Trapezoidal spaces 52 are thus defined between adjacent teeth 42, 48. When viewed from a direction perpendicular to the longitudinal extent of the flitch 30, and particularly when viewed from a direction perpendicular to the flitch table 49 (as in FIG. 2), each tooth 48 is centered on the space 52 between its nearest neighbor teeth 42. Similarly, each tooth 42 is centered in the space 52 between its nearest neighbor teeth 48.

As best illustrated in FIG. 1, a line between the tip 54 of a tooth 42 and the tip 56 of a tooth 48 projects onto the plane of FIG. 1, which is generally perpendicular to the longitudinal extent of the flitch 30, an angle of about 30° with the mounting surface 58 of flitch table 49 of veneer slicer 22.

Figure 3:
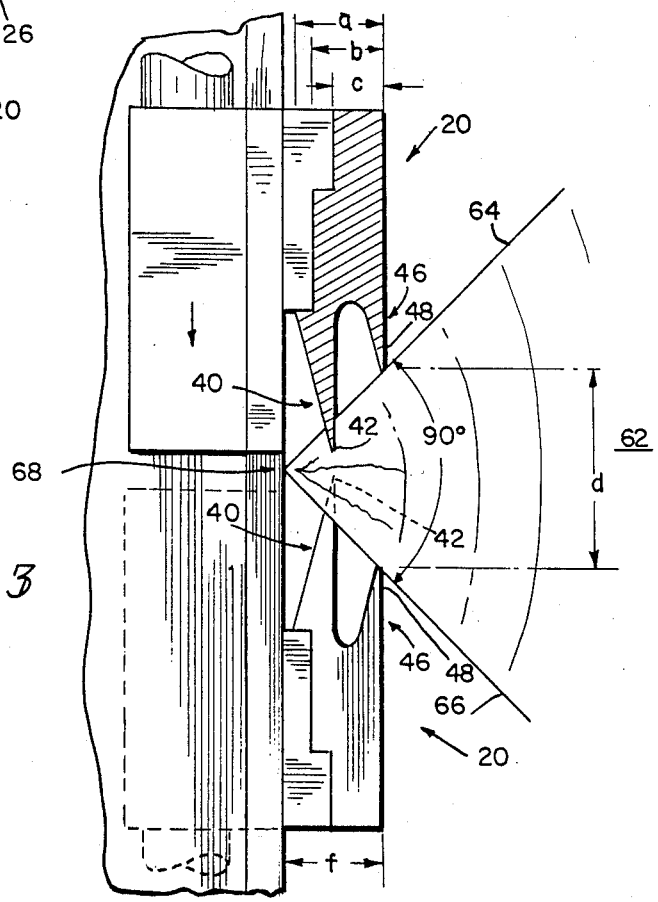
FIG. 3 illustrates a cross section of a 90° sector flitch, or quarter, with two dogs according to the present invention holding the flitch in position against a flitch table.

Referring now to FIG. 3, two dogs 20 are shown engaging a quarter 62. As illustrated, sufficient pressure is exerted by the teeth 42 of the first row 40 on the quarter 62 for the teeth 42 to bite into the upper surface 64 of quarter 62. The teeth 42 of the first row 40 of the lower dog 20 bite into the lower surface 66 of quarter 62 at points spaced longitudinally from the position of the upper dog 20. This minimizes the likelihood that any weakness which will result from the penetration of the teeth 42 into the upper and lower surfaces 64, 66 of quarter 62 will break out quarter 62 near its apex 68 and thus weaken the hold that the dogs 20 have on the quarter 62.

Illustrative dimensions for the dogs 20 and the waste sections or dog boards follow, with reference to the small letters in FIGS. 1–3.

TABLE I

| Dimension | Measurement |
|---|---|
| a | 30 mm |
| b | 22 mm |
| c | 17 mm |
| d | 70 mm |
| e | 120 mm |
| f | 35 mm |
| g | 25 mm |
| h | 37 mm |
| i | 20 mm |
| j | 82 mm |
| k | 108 mm |
| l | 140 mm |

Significant advantages are available using the dogs of the present arrangement. First, the apex 32, 68 of the third 30 or quarter 62 need not be cut or dressed prior to mounting the third 30 or quarter 62. This reduces the amount of waste to that of the dog boards themselves. Additionally, any tendency on the part of the flitch to rock or twist in either direction as it encounters the knife and pressure bar of the veneer slicer forces the teeth 42, 48 of the first and second rows 40, 46, respectively, of both upper and lower dogs 20 to engage the surfaces 24, 26, 64, 66 even more firmly.

What is claimed is:

1. A dog for a veneer slicer, the dog comprising means for mounting the dog to the slicer to hold a flitch to the slicer, the dog including a row of first teeth having first edges extending generally longitudinally of the flitch along a first line for engagement in the flitch to assist in holding the flitch on the slicer so that veneer can be sliced from it, and a row of second teeth having second edges extending generally longitudinally of the flitch along a second line for engagement in the flitch to assist in holding the flitch on the slicer.

2. The dog of claim 1 wherein the second line is generally parallel to the first.

3. The dog of claim 1 wherein each tooth of the first row is substantially equidistantly spaced from adjacent teeth of the first row defining substantially uniform spaces between the teeth of the first row longitudinally of the flitch.

4. The dog of claim 3 wherein each tooth of the second row is substantially equidistantly spaced from adjacent teeth of the second row defining substantially uniform spaces between the teeth of the second row.

5. The dog of claim 4 wherein the teeth of the second row lie in the spaces between the teeth of the first row when viewed from a direction perpendicular to the longitudinal extent of the flitch.

6. The dog of claim 5 wherein the teeth of the second row are generally centered in the spaces between the teeth of the first row when viewed from a direction perpendicular to the longitudinal extent of the flitch.

7. The dog of claim 6 wherein a line between the first edge and the second edge projects onto a plane perpendicular to the longitudinal extent of the flitch an angle of about 30° with a mounting surface of the slicer against which the flitch is to be held for slicing.

8. The dog of claim 1 wherein a line between the first edge and the second edge projects onto a plane perpendicular to the longitudinal extent of the flitch an angle of about 30° with a mounting surface of the slicer against which the flitch is to be held for slicing.

9. A dog for a veneer slicer, the dog comprising means for mounting the dog to the slicer to hold a flitch to the slicer, the dog including a first row of teeth, the first row extending generally longitudinally of the flitch for engagement in the flitch to assist in holding the flitch on the slicer so that veneer can be sliced from it, and a second row of teeth, the second row extending generally parallel to the first row for engagement in the flitch to assist in holding the flitch on the slicer.

10. The dog of claim 9 wherein each tooth of the first row is substantially equidistantly spaced from adjacent teeth of the first row defining substantially uniform spaces between the teeth of the first row longitudinally of the flitch, and each tooth of the second row is substantially equidistantly spaced from adjacent teeth of the second row defining substantially uniform spaces between the teeth of the second row longitudinally of the flitch.

11. The dog of claim 10 wherein the teeth of the second row lie in the spaces between the teeth of the first row when viewed from a direction perpendicular to the longitudinal extent of the flitch.

12. The dog of claim 11 wherein the teeth of the second row are generally centered in the spaces between the teeth of the first row when viewed from a direction perpendicular to the longitudinal extent of the flitch.

13. The dog of claim 12 wherein a line between the tip of a tooth of the first row and the tip of a tooth of the second row projects onto a plane perpendicular to the longitudinal extent of the flitch an angle of about 30° with a mounting surface of the slicer against which the flitch is to be held for slicing.

14. The dog of claim 9 wherein a line between the tip of a tooth of the first row and the tip of a tooth of the second row projects onto a plane perpendicular to the longitudinal extent of the flitch an angle of about 30° with a mounting surface of the slicer against which the flitch is to be held for slicing.

* * * * *